US005248244A

United States Patent [19]

Ho et al.

[11] Patent Number: 5,248,244

[45] Date of Patent: Sep. 28, 1993

[54] SCROLL COMPRESSOR WITH A THERMALLY RESPONSIVE BYPASS VALVE

[75] Inventors: Yung Ho, Liverpool; Thomas R. Barito, East Syracuse; Hussein E. Khalifa, Manlius; John P. Giffune, Syracuse, all of N.Y.

[73] Assignee: Carrier Corporation, Syracuse, N.Y.

[21] Appl. No.: 993,556

[22] Filed: Dec. 21, 1992

[51] Int. Cl.[5] ..... F04B 49/00

[52] U.S. Cl. ..... 417/292; 417/310

[58] Field of Search ..... 417/292, 310

[56] References Cited

U.S. PATENT DOCUMENTS

| | | | |
|---|---|---|---|
| 4,820,130 | 4/1989 | Eber et al. | 417/292 |
| 5,167,491 | 12/1992 | Keller, Jr. et al. | 417/292 |
| 5,186,613 | 2/1993 | Kotlarek et al. | 417/292 |

FOREIGN PATENT DOCUMENTS

| | | | |
|---|---|---|---|
| 3-092592 | 4/1991 | Japan | 417/292 |

*Primary Examiner*—Richard A. Bertsch
*Assistant Examiner*—Alfred Basichas

[57] ABSTRACT

A thermally responsive valve establishes a discharge to suction bleed responsive to the actuation of a thermal actuator. The thermal actuator is responsive to the temperature of the floor of the fixed scroll in a region near the outlet so that the actuator is responsive to local conditions indicative of impending failure.

5 Claims, 3 Drawing Sheets

SCROLL COMPRESSOR WITH A THERMALLY RESPONSIVE BYPASS VALVE

BACKGROUND OF THE INVENTION

Low side hermetic refrigeration compressors are those in which most, if not all, of the interior of the shell is at suction pressure. Normally, some, or all, of the suction flow is used to cool the motor which is provided with a thermal protector. The thermal protector causes the motor, and thereby the compressor, to stop when the motor overheats.

In U.S. Pat. No. 5,141,407 it is recognized that hot, discharge gas could cause the thermal protector to react and stop the compressor. To cause the thermal protector to react, a discharge to suction/shell interior bypass is controlled by a thermally responsive valve which senses and reacts to the temperature of the discharge gas. As a result, the compressor can be stopped responsive to conditions resulting in an excessive discharge temperature. These conditions include the loss of working fluid charge, a blocked condenser fan in a refrigeration system and a low pressure condition or a blocked suction condition. Thus, the thermal protection disclosed in U.S. Pat. No. 5,141,407 is basically that of "general heat" where the heat is generated all around the scroll as friction heat caused by lack of lubrication, the thermodynamic heat of the compressed gas, high motor temperature and/or high ambient temperature. The basic presumption of this approach is, however, that the discharge gas temperature always follows closely the actual failure indication which is not always true.

In addition to general heat there can be "local heat" which is heat generated in a certain area. The source of local heat is usually localized high friction caused by a concentrated load. With local heat, the amount of total heat may not be sufficient to significantly influence the temperature of the discharge gas such as under the high mass flow conditions associated with a blocked condenser fan. Thus, a gas temperature sensing device may not detect an incipient failure caused by local friction.

Scroll compressors are unusual in that there is a continuous progression of the compression process from the outermost suction region to the inner discharge region and in that relative movements between contacting points on the two scrolls is limited to a circle, the orbit, which is typically 0.5 inches or less. As a result, there is a thermal gradient from the outer periphery to the center of the scrolls and contact between the members is localized. The wraps of a scroll compressor exhibit a differential thermal growth reflecting the thermal gradient, with the inner portion of the wraps having the greatest thermal growth. A "worn in" scroll wrap will, typically, be dished concavely at ambient temperatures and planar at operating temperatures. During abusive conditions such as loss of working fluid charge, the compressor may operate at high pressure ratios which can lead to high discharge temperatures. Due to thermodynamic heat, the resultant thermal gradient causes the inner portion of the scrolls to expand beyond the "normal" planar state and results in convex dishing. This will cause the axial thrust load to be concentrated on a very small area near the center of the scroll wrap. The failure mechanism for a scroll compressor under these conditions could be excessive wear of the scroll surface and/or galling near the center. Galling is a continuous weld-tear between the wrap tip and floor of coacting scroll members. The major factors that contribute to failure are (1) heat generated in the compressor which causes breakdown of oil, reducing lubrication and increasing friction and friction heat between the scrolls, and (2) high net axial thrust force or concentrated thrust loading between the scrolls which can increase friction and create more friction heat.

Loss of working fluid charge creates significant local and general heat. As charge is lost from the system, the discharge to suction gas pressure ratio increases. As the pressure ratio increases, the temperature difference between suction and discharge increases and results in dishing of the scroll members which eventually creates a high spot. The high spot takes all the load (normal force) and causes high local friction and resultant local heat. Additionally, because the lubrication media is oil entrained in the refrigerant, the reduction in mass flow reduces the available lubrication for the scrolls, increasing friction and its resultant general heat. The normal thermodynamic heating of the gas will also provide general heat.

SUMMARY OF THE INVENTION

The protection mechanism senses a pre-failure mode as a high fixed scroll floor temperature in the vicinity of the protection mechanism and may therefore be a local or a general heating. Responsive to the sensed high fixed scroll floor temperature, a valve is opened to bleed high temperature and pressure gas to the suction side represented by the interior of the shell. The opening of the valve (1) reduces the pressure ratio because there is a leak from high to low pressure regions; (2) heats the linebreak/motor overheat protector which trips if heated sufficiently and thereby stops the motor; (3) reduces the flow that goes to refrigeration system and gets cooled; and, (4), in essence, cuts off the flow of cool gas around the motor.

It is an object of this invention to sense initial indications of a pre-failure mode of a scroll compressor during a loss of charge condition.

It is another object of this invention to stop a compressor responsive to a sensed pre-failure mode. These objects, and others as will become apparent hereinafter, are accomplished by the present invention.

Basically, a thermally responsive sensor is located in the fixed scroll in the general area of the outlet and, responsive to the sensing of a excess temperature indicative of a pre-failure mode, opens a bypass between the discharge and the interior of the shell thereby causing the thermally responsive line break to trip.

BRIEF DESCRIPTION OF THE DRAWING

For a fuller understanding of the present invention, reference should now be made to the following detailed description thereof taken in conjunction with the accompanying drawings wherein.

DESCRIPTION OF THE PREFERRED EMBODIMENTS

Figure 1:
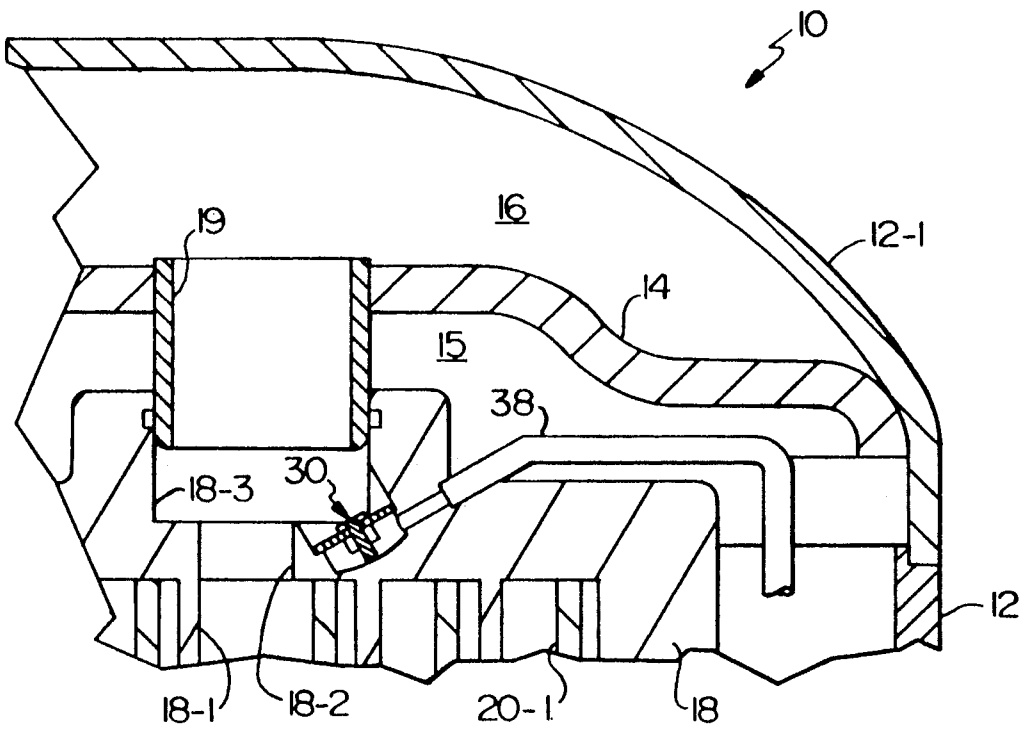
FIG. 1 is a partial sectional view of a low side scroll compressor employing the thermally responsive bypass valve of the present invention.

In FIG. 1, the numeral 10 generally designates a low side hermetic scroll compressor. Compressor 10 has a shell 12 with an end cap 12-1 and a separator plate 14 which divides the interior of the shell 12 into a suction chamber 15 and a discharge chamber 16. Fixed or non-orbiting scroll 18 has a wrap 18-1, discharge port 18-2 and bore 18-3 which receives discharge tube 19. An orbiting scroll coacts with fixed scroll 18 but only the wrap 20-1 is illustrated. The structure described so far is generally conventional and would operate in a conventional manner.

Figure 3:
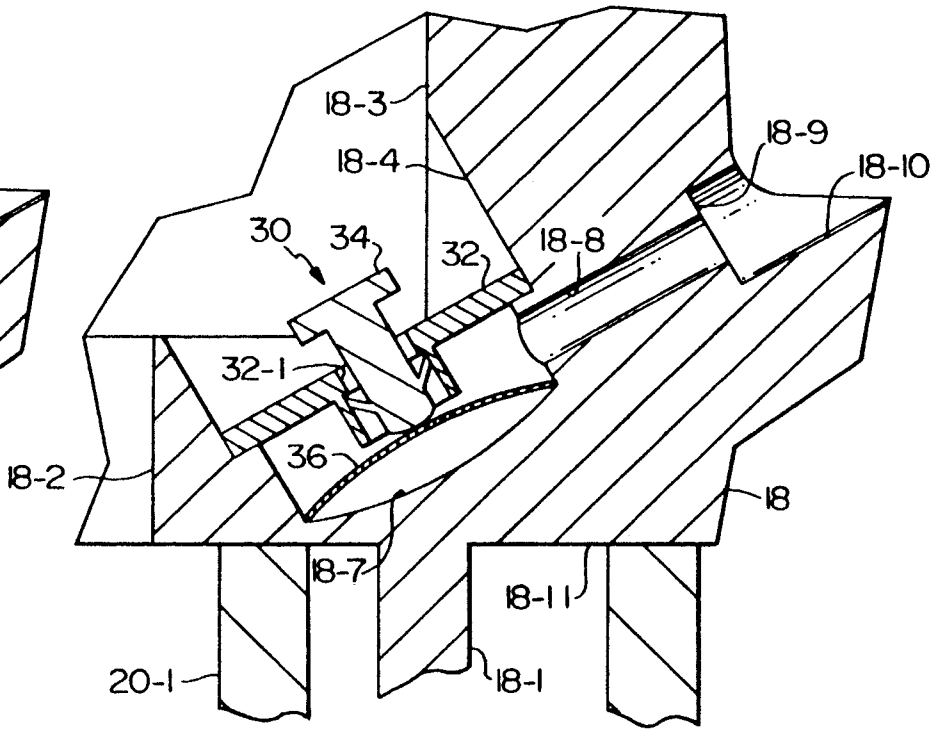
FIG. 3 is a view of the bypass valve of FIG. 2 in the open position.
Figure 2:
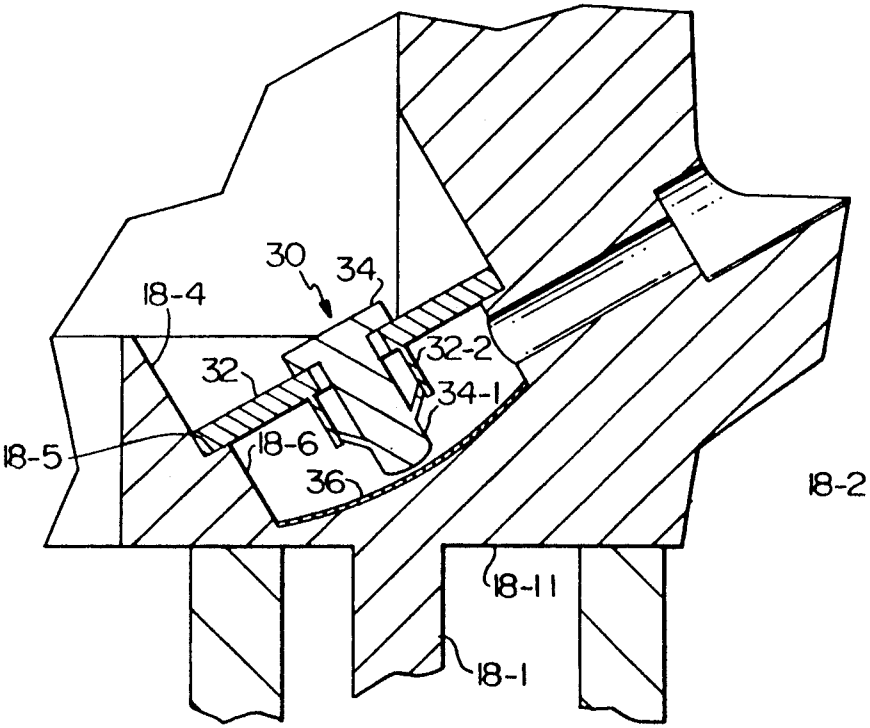
FIG. 2 is an enlarged sectional view of the bypass valve of FIG. 1 in the closed position.

Referring to FIGS. 1–3 it will be noted that fixed scroll 18 has bores 18-4 and 18-6 which coact to form shoulder 18-5 therebetween. Bore 18-6 has a dished end surface 18-7 which is in close proximity to the floor 18-11 of fixed scroll 18. Bore 18-8 intersects bore 18-6 and coacts with bore 18-10 to define shoulder 18-9. Thermally responsive bypass valve 30 is located in bores 18-4 and 18-6 and includes disc 32 which is press fit or otherwise suitably located in bore 18-4 and supported by shoulder 18-5. Disc 32 has an opening 32-1 which is surrounded by sleeve portion 32-2 which extends into bore 18-6. Valve member 34 seats on disc 32 and blocks opening 32-1, as shown in FIGS. 1 and 2. Valve 34 has a stem 34-1 which is received in and guided by sleeve 32-2. Actuator 36 may be a bimetal snap disc or of shape memory alloy and generally conforms to the shape of end surface 18-7 in the unactuated configuration of FIG. 2.

In operation, the fixed and orbiting scrolls coact to compress refrigerant gas which serially passes through discharge port 18-2, bore 18-3 and discharge tube 19 into discharge chamber 16 from which is passes to the refrigeration system (not illustrated). As is clear from FIGS. 1–3, the tip of wrap 20-1 is coacting with the floor 18-11 as well as wrap 18-1 of scroll 18 and that the floor 18-11 is in close proximity to surface 18-7. Because surface 18-7 is in proximity to the discharge portion of the fixed scroll 18 it is in the region that is subject to the greatest thermal growth of the wraps 18-1 and 20-1. Being somewhat downstream from the suction side and therefore more likely to be affected by inadequate lubrication or the like, the portion of the wraps 18-1 and 20-1 in the vicinity of surface 18-7 are more likely to be subject to localized heating as from friction. Upon heating of the floor 18-11 in the vicinity of surface 18-7, the heat is transmitted to actuator 36. Upon a sufficient heating of actuator 36, actuator 36 goes from its FIG. 2 configuration to its FIG. 3 configuration and causes the unseating of valve 34. With valve 34 unseated, as shown in FIG. 3, a discharge to suction bleed is established whereby discharge gas serially passes from bore 18-3, into bore 18-4, through opening 32-1 and sleeve 32-2 into bore 18-6 from which it passes to bore 18-8 and bore 18-10. From bore 18-10, the discharge bleed may be directed via a tube 38, as illustrated in FIG. 1, to a desired locations such as to the motor thermal protector, or to the suction chamber 15 defined by shell 12 as shown in FIGS. 2 and 3. Although actuator 36 is shown as a separate member, it can be attached to stem 34-1, if necessary or desired.

Figure 4:
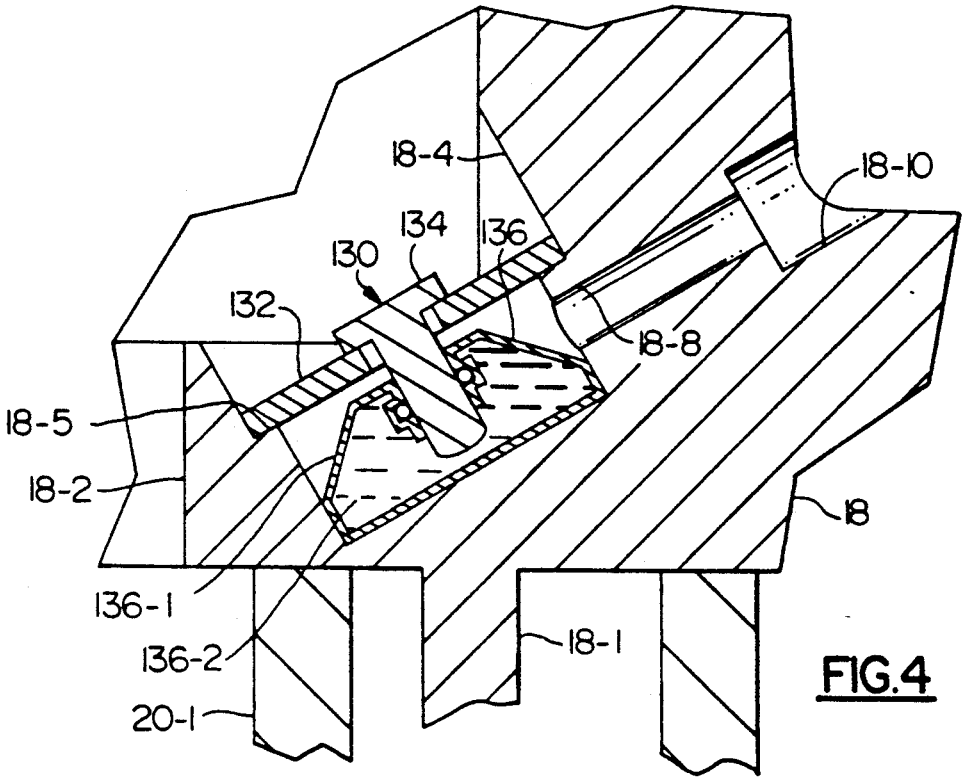
FIG. 4 is an enlarged sectional view of a modified bypass valve in the closed position.
Figure 5:
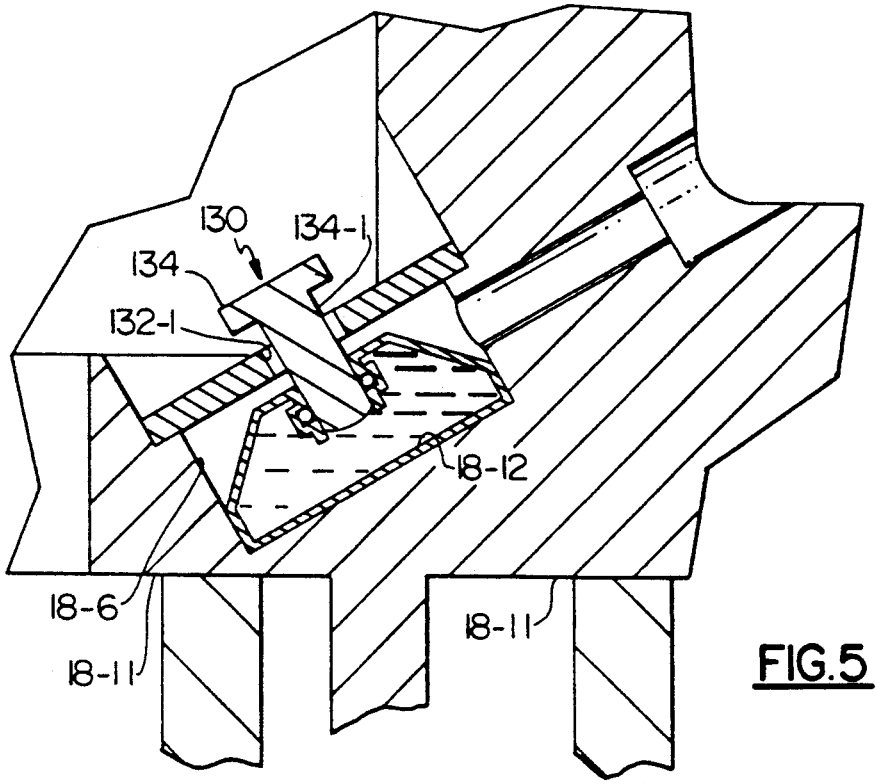
FIG. 5 is a view of the bypass valve of FIG. 4 in the open position.

Thermally responsive bypass valve 130 of FIGS. 4 and 5 is similar to valve 30 but relies upon a phase change material to cause its opening. Disc 132 has an opening 132-1 and is press fit or otherwise suitably secured in bore 18-4 so that it rests on shoulder 18-5. Valve member 134 has a stem 134-1 which extends through opening 132-1 and is sealingly and reciprocatably received in actuator 136 which includes a sealed container 136-1 which is filled with a phase change material 136-2. Phase change material 136-2 can be a wax that melts and increases in volume as the temperature increases, a liquid that changes to a gas and increases in volume as the temperature rises, or any suitable conventional phase change material. Because sealed container 136-1 does not change shape, dished end surface 18-7 may suitably be replaced with a flat surface 18-12, or a shape conforming to the corresponding portion of container 136-1.

In operation, heating of the floor 18-11 in the vicinity of surface 18-12 is transmitted to actuator 136. Upon a sufficient heating of container 136-1 and thereby phase change material 136-2 contained therein, the phase change material 136-2 expands in volume and acts on the end of stem 134-1 which functions as a piston. The increased volume moves valve 134 from the FIG. 4 position to the FIG. 5 position causing the unseating of valve 134. With valve 134 unseated, as shown in FIG. 5, a discharge to suction bleed is established whereby discharge gas serially passes from bore 18-3, into bore 18-4, through opening 132-1 into bore 18-6 from which it passes to bore 18-8 and bore 18-10. From bore 18-10, the discharge bleed may be directed via tube 38, as shown on FIG. 1, to a desired location, or to the suction chamber 15.

Although preferred embodiments of the present invention have been illustrated and described, other changes will occur to those skilled in the art. It is therefore intended that the present invention is to be limited only by the scope of the appended claims.

What is claimed is:

1. A low side hermetic scroll compressor means comprising a shell having a suction chamber therein;

first and second coacting scroll members in said shell;

said first scroll member having a wrap and a floor;

a discharge path extending through said first scroll member;

a bleed path extending through said first scroll member and connecting said discharge path and said suction chamber;

normally closed valve means in said bleed path and including thermally responsive means;

said thermally responsive means located in said first scroll member at a position in proximity to said floor whereby an excessive heating of said floor in proximity to said thermally responsive means causes said thermally responsive means to open said normally closed valve means and permit flow through said bleed path.

2. The scroll compressor means of claim 1 wherein said thermally responsive means includes a phase change material.

3. The scroll compressor means of claim 1 wherein said thermally responsive means is a bimetal.

4. The scroll compressor means of claim 1 wherein said thermally responsive means is located in a bore in said first scroll and in contact with a surface defining an end of said bore and which is in proximity to an inner turn of said wrap.

5. The scroll compressor means of claim 1 wherein said thermally responsive means is of a shape memory alloy.

* * * * *